US010852106B2

(12) United States Patent
Beal

(10) Patent No.: US 10,852,106 B2
(45) Date of Patent: Dec. 1, 2020

(54) FIREARM AMMUNITION WITH PROJECTILE HOUSING PROPELLANT

(71) Applicant: Meals, LLC, Rockford, TN (US)

(72) Inventor: Harold F. Beal, Rockford, TN (US)

(73) Assignee: Meals, LLC, Rockford, TN (US)

( * ) Notice: Subject to any disclaimer, the term of this patent is extended or adjusted under 35 U.S.C. 154(b) by 0 days.

(21) Appl. No.: 16/219,314

(22) Filed: Dec. 13, 2018

(65) Prior Publication Data

US 2019/0120601 A1 Apr. 25, 2019

Related U.S. Application Data

(63) Continuation-in-part of application No. 15/651,740, filed on Jul. 17, 2017, now Pat. No. 10,161,726, which is a continuation of application No. 14/822,183, filed on Aug. 10, 2015, now Pat. No. 9,739,579.

(60) Provisional application No. 62/040,781, filed on Aug. 22, 2014.

(51) Int. Cl.

| | |
|---|---|
| ***F42B 5/02*** | (2006.01) |
| ***F42C 19/08*** | (2006.01) |
| ***F42B 5/16*** | (2006.01) |
| ***F42B 5/10*** | (2006.01) |

(52) U.S. Cl.

CPC ..... *F42B 5/02* (2013.01); *F42B 5/105* (2013.01); *F42B 5/16* (2013.01); *F42C 19/0807* (2013.01)

(58) Field of Classification Search

CPC ..... F41A 9/66; F42B 5/02; F42B 5/16; F42B 5/26; F42B 5/285; F42B 5/307; F42B 5/34; F42B 8/10; F42B 8/16; F42B 33/02; F42B 33/0207; F42B 33/0285; F42B 33/0292; F42B 5/105

USPC ..... 102/505, 508, 464, 443, 444, 447, 455, 102/430, 467, 380

See application file for complete search history.

(56) References Cited

U.S. PATENT DOCUMENTS

| | | | | | |
|---|---|---|---|---|---|
| 539,327 | A * | 5/1895 | Aikin | F42B 8/02 | 102/447 |
| 2,263,941 | A * | 11/1941 | Albree | F42B 5/02 | 102/464 |
| 2,407,264 | A * | 9/1946 | Ferrel | F42B 5/10 | 102/380 |
| 2,613,604 | A * | 10/1952 | Pyle | F42B 5/10 | 102/439 |
| 3,099,958 | A * | 8/1963 | Daubenspeck | F42B 7/06 | 102/449 |
| 3,245,348 | A * | 4/1966 | Lahr | F41C 3/00 | 102/441 |
| 3,435,768 | A * | 4/1969 | Engel | F42B 14/064 | 102/513 |
| 3,724,377 | A * | 4/1973 | Birkigt | F42B 5/16 | 102/376 |

(Continued)

*Primary Examiner* — John Cooper
(74) *Attorney, Agent, or Firm* — Pitts & Lake, P.C.

(57) ABSTRACT

A firearm ammunition cartridge including a case having a substantially tubular body portion, an open leading end, and a trailing end defining a primer port, the primer port opening to an interior of the case, a projectile received and retained within the leading end of the case, and configured with a recess extending inwardly from a trailing end of the projectile to receive a quantity of gunpowder, and a quantity of compressed gunpowder provided in the recess of the projectile such that the compressed gunpowder remains in the recess at any orientation of the projectile.

13 Claims, 4 Drawing Sheets

(56) References Cited

U.S. PATENT DOCUMENTS 3,829,537 A * 8/1974 Rosenthal ..... C06B 21/0091 264/3.1
3,988,990 A * 11/1976 MacDonald, Jr. ..... F42B 10/40 102/380
4,157,684 A * 6/1979 Clausser ..... F42B 5/02 102/430
4,162,645 A * 7/1979 Abbott ..... F42B 8/04 86/23
4,173,186 A * 11/1979 Dunham ..... F42B 29/00 102/430
4,470,604 A * 9/1984 Hoffmann ..... F41J 13/02 102/529
4,754,704 A * 7/1988 Lubbers ..... F42B 5/16 102/275.11
5,359,937 A * 11/1994 Dittrich ..... F42B 14/064 102/430
5,408,931 A * 4/1995 Tallman ..... F42B 7/10 102/434
5,677,505 A * 10/1997 Dittrich ..... F42B 5/02 102/430
5,770,815 A * 6/1998 Watson, Jr. ..... F42B 5/16 102/439
6,283,035 B1 * 9/2001 Olson ..... F42B 5/02 102/439
9,032,855 B1 * 5/2015 Foren ..... F42B 33/00 102/466
9,182,204 B2 * 11/2015 Maljkovic ..... F42B 33/10
9,200,880 B1 * 12/2015 Foren ..... F42B 33/02
2010/0275804 A1 * 11/2010 Trivette ..... F42B 7/06 102/448
2013/0014664 A1 * 1/2013 Padgett ..... F42B 5/313 102/439
2014/0060373 A1 * 3/2014 Maljkovic ..... F42B 33/10 102/467
2016/0349022 A1 * 12/2016 Burrow ..... F42B 5/26

* cited by examiner

FIREARM AMMUNITION WITH PROJECTILE HOUSING PROPELLANT

CROSS-REFERENCE TO RELATED APPLICATIONS

This application is a continuation-in-part application of U.S. patent application Ser. No. 15/651,740, filed on Jul. 17, 2017, which is a continuation of U.S. patent application Ser. No. 14/822,183, filed on Aug. 10, 2015, which in turn claims the benefit of U.S. Provisional Patent Application No. 62/040,781, filed on Aug. 22, 2014, each of which is incorporated herein in its entirety by reference.

STATEMENT REGARDING FEDERALLY-SPONSORED RESEARCH OR DEVELOPMENT

Not Applicable

BACKGROUND OF THE INVENTION

1. Field of Invention

This invention relates to firearm ammunition and methods of manufacture thereof. More particularly, this invention relates to an insert for firearm ammunition which may encourage a more consistent ignition of gunpowder during firing of the ammunition.

2. Description of the Related Art

Ammunition cartridges of the type commonly used in modern firearms are generally known in the art. An ammunition cartridge typically includes a generally cylindrical case which is sized and shaped to correspond to the interior of a firing chamber of a firearm. The case includes an open leading end having a projectile held therein. When the cartridge is received within the chamber, the leading end of the case carrying the projectile faces toward and along the bore of the firearm. A primer is fixed proximate a trailing end of the case, such that the case and primer cooperate to seal the firing chamber of the firearm in all directions except toward the bore of the firearm. The primer includes a small charge of impact-sensitive, ignitable chemical mixture. When the firearm is fired, a firing pin strikes the primer and ignites the chemical mixture. The chemical mixture deflagrates to produce a jet of burning gas within the case. This burning gas is used to ignite a measure of propellant, typically gunpowder, housed within the case. When burned, the propellant produces significant quantities of gasses which push the projectile from the open end of the case, down the bore, and out from the muzzle of the firearm.

The velocity at which the projectile is discharged from the muzzle of the firearm is a function of, among other things, the quantity of propellant burned in the case, and thus the quantity of gasses produced, during the firing process, and the rate at which the propellant is burned and the gasses are produced. Thus, in order to achieve a desired velocity of the projectile from the firearm muzzle, the volume of propellant housed within the case of a given ammunition cartridge is often carefully selected and measured during manufacture of the cartridge. Typically, the volume of propellant selected for a given ammunition cartridge does not fill the entire volume of the case interior, and a void is allowed within the case.

In certain shooting situations, it is desirable to provide a measure of propellant within the case which leaves a substantial portion of the interior volume of the case void of propellant. For example, in certain shooting situations, it is desirable that the projectile fired from a firearm travel at less than supersonic velocity. This shooting situation can occur, for example, in the course of military and law enforcement activities, such as in sniper fire or other activity wherein it is desired that the location of the shooter not be detectable by reason of the sound associated with the firing of the firearm and the path of travel of the projectile. Firearm ammunition heretofore intended to provide for subsonic velocity of the projectile thereof upon firing of the ammunition traditionally has been manufactured by providing a reduced quantity of gunpowder in the case of each round of the ammunition as compared to sonic or supersonic loads of the same size and caliber. This method often leaves a very substantial portion of the interior volume of the subsonic ammunition case void of either powder and/or projectile.

In ammunition cartridges of the type described above, in which a large void is provided in the case, the propellant within the case is free to flow into one or the other end of the case, depending upon whether the firearm being used is aimed upwardly from the horizontal or downwardly from the horizontal. When the propellant shifts to the leading end of the case (adjacent the projectile and away from the primer in the closed end of the case), the jet of burning gas generated upon the firing pin striking the primer must pass through the void space between the primer and the propellant before reaching and igniting the propellant. This situation creates at least two undesirable factors, namely: (a) delay or failure in ignition of the propellant and/or (b) poor exposure of the propellant to the burning gas. The first of these factors can be so serious as to cause the shooter to believe that he has experienced a misfire, to cause the shooter to pull his/her sight off the target, and/or to damage the firearm. The second of these factors may result in insufficient ignition of the propellant and a burn pattern of the propellant which causes inconsistent propulsion of the projectile from the firearm, hence impairment of the shooter to hit a desired target at a desired velocity. When the powder shifts toward the primer-containing closed end of the case, these factors are generally reversed, causing undesirable increase in burn rate of the propellant, and corresponding increase in velocity of the projectile, as well as other deleterious results.

In light of the above, a cartridge of firearm ammunition which achieves more consistent ignition of the gunpowder within the case of the cartridge throughout a broad range of orientations of the round is desired. Other objects and advantages of the present general inventive concept will be recognized from the present specification, including the claims and the drawings appended hereto.

BRIEF SUMMARY OF THE INVENTION

The present general inventive concept, in various embodiments, provides an insert for a firearm ammunition cartridge which maintains a quantity of gunpowder in a relatively stable position within the cartridge, and a firearm ammunition cartridge having such an insert. Various example embodiments of the present general inventive concept may be achieved by providing a case having a substantially tubular body portion, an open leading end, and a trailing end defining a primer port, the primer port opening to an interior of the case. An insert may be received within the case and may extend along the body portion. The insert may have an exterior surface conforming to an interior surface of the body portion and a central cavity extending along an axial dimension of the insert. The central cavity may open to the primer port at the trailing end of the case and may open to a leading end of the insert. A quantity of gunpowder may be disposed within the central cavity. A projectile may be received and retained within the leading end of the case. Thus, the gunpowder may be confined to a chamber comprising at least a portion of the central cavity between the case trailing end and the projectile.

In various example embodiments of the present general inventive concept, a trailing end of the projectile may close a leading end of the central cavity. In various embodiments, the quantity of gunpowder may define a volume approximately equal to a volume of the central cavity between the trailing end of the projectile and the trailing end of the case. In various embodiments, the central cavity may define a cylindrical leading portion having a first diameter and a cylindrical trailing portion having a second diameter. In various embodiments, the leading portion and the trailing portion of the central cavity may be coaxial with one another and with an axial dimension of the primer port. In various embodiments, the leading portion of the central cavity may have a diameter substantially equal to a trailing end of the projectile. In various embodiments, the trailing end of the projectile may be received within the leading portion of the central cavity. In various embodiments, the trailing portion of the central cavity may have a diameter substantially equal to a diameter of the primer port. In various embodiments, the leading portion of the central cavity may have a diameter greater than a diameter of the trailing portion. In various embodiments, the central cavity may further define a cylindrical central portion having a third diameter. In various embodiments, the leading portion of the central cavity may a diameter substantially equal to a trailing end of the projectile, the trailing portion of the central cavity may have a diameter substantially equal to a diameter of the primer port, and the central portion of the central cavity may have a diameter greater than the diameter of the leading portion and the diameter of the trailing portion. In such embodiments, the trailing end of the projectile may be received within the leading portion of the central cavity. In various embodiments, the insert may be fixed within the case. In various embodiments, the case may define a tapered portion between the body portion and the leading end, and the exterior surface of the insert may have a leading portion conforming to an interior surface of the tapered portion of the case. Thus, the tapered portion may retain the insert within the case between the tapered portion and the trailing end of the case.

Various example embodiments of the present general inventive concept may be achieved by providing an insert for a firearm ammunition case comprising a substantially rigid member defining a leading end, an opposite trailing end, and an exterior surface between the leading and trailing ends. The exterior surface may be shaped to conform to at least a portion of an interior surface of a firearm ammunition case between a trailing end of the case and a leading tapered portion of the case. The member may further define a central cavity extending between and opening to the leading and trailing ends of the member. The central cavity may be sized to receive a quantity of gunpowder therein and to maintain the quantity of gunpowder proximate a trailing end of the case.

In various example embodiments of the present general inventive concept, the exterior surface may define a tapered portion proximate the leading end. The tapered portion may be shaped to conform to an interior surface of a tapered portion of a firearm ammunition case. In various embodiments, the central cavity may define a cylindrical leading portion having a first diameter and a cylindrical trailing portion having a second diameter. In various embodiments, the leading portion and the trailing portion of the central cavity may be coaxial with one another and with an axial dimension of the exterior surface. In various embodiments, the leading portion of the central cavity may have a diameter substantially equal to a trailing end of an ammunition projectile. In various embodiments, the trailing portion of the central cavity may have a diameter substantially equal to a diameter of an ammunition primer port. In various embodiments, the central cavity may further define a cylindrical central portion having a third diameter greater than the first and second diameters.

Various example embodiments of the present general inventive concept may be achieved by providing a firearm ammunition cartridge including a case having a substantially tubular body portion, an open leading end, and a trailing end defining a primer port, the primer port opening to an interior of the case, a projectile received and retained within the leading end of the case, and configured with a recess extending inwardly from a trailing end of the projectile to receive a quantity of gunpowder, and a quantity of compressed gunpowder provided in the recess of the projectile such that the compressed gunpowder remains in the recess at any orientation of the projectile.

Other features and aspects may be apparent from the following detailed description, the drawings, and the claims.

BRIEF DESCRIPTION OF THE SEVERAL VIEWS OF THE DRAWINGS

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION OF THE INVENTION

Reference will now be made to the example embodiments of the present general inventive concept, examples of which are illustrated in the accompanying drawings and illustrations. The example embodiments are described herein in order to explain the present general inventive concept by referring to the figures. The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper," "trailing," "leading," and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Figure 2:
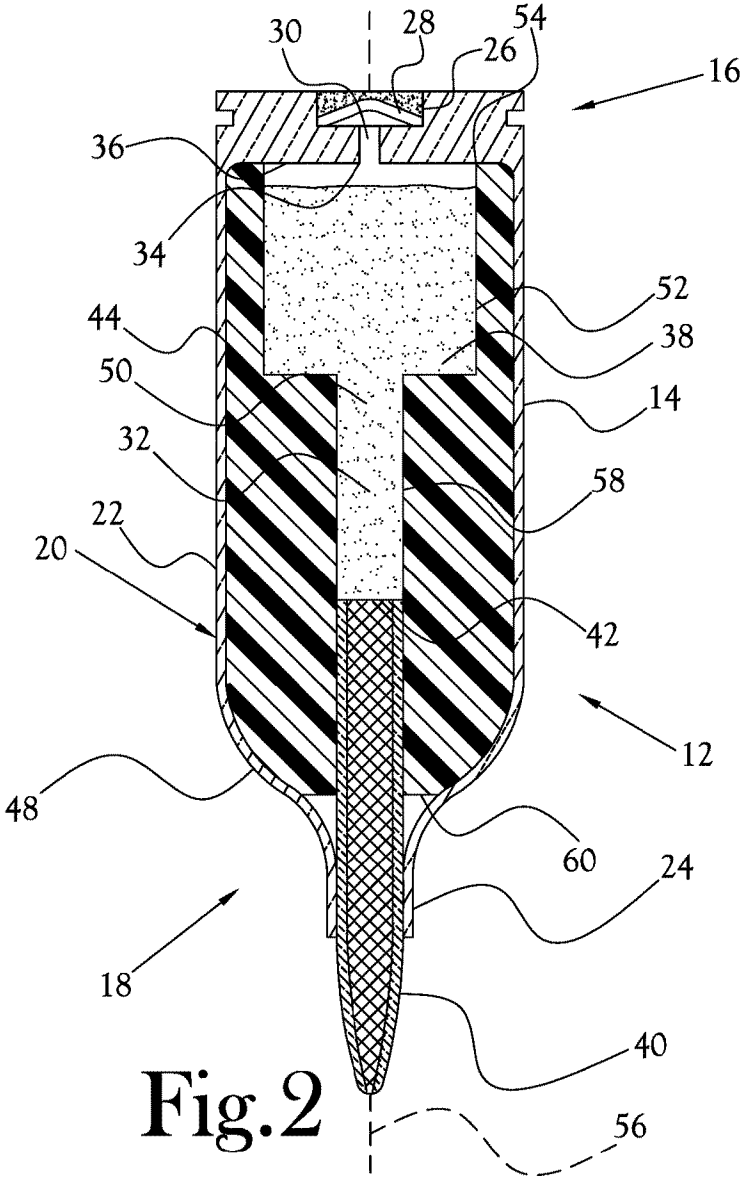
FIG. 2 is another cross-sectional side view of the embodiment of FIG. 1.
Figure 1:
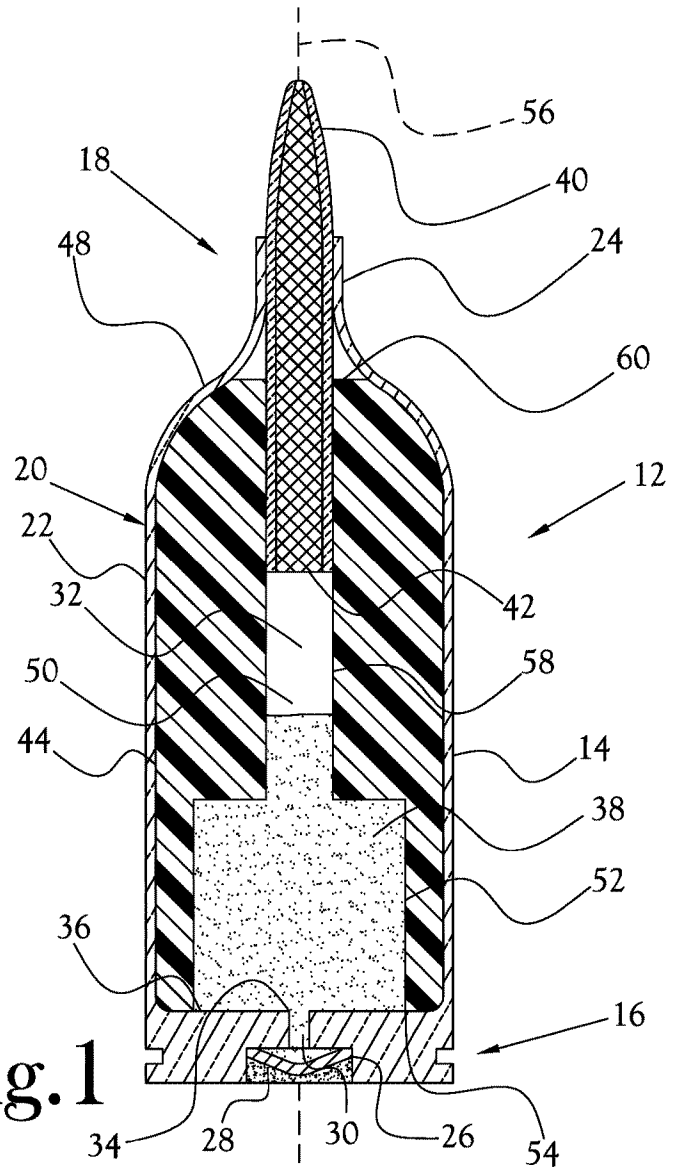
FIG. 1 is a cross-sectional side view of one embodiment of a round of firearm ammunition embodying various features of the present general inventive concept.

With reference now to FIGS. 1 and 2, there is depicted a cross-sectional view of one embodiment of a firearm ammunition cartridge 12 constructed in accordance with several features of the present general inventive concept. The firearm ammunition cartridge 12, or "cartridge," includes a case 14 of the type having a trailing end 16, an open leading end 18, and a body 20 which includes a generally hollow trailing tubular portion 22 that transitions into a "necked down" leading tubular portion 24. The trailing end 16 of the case is substantially closed and includes a primer port 26 within which there is disposed a primer 28. The primer port 26 is accessible from the exterior of the case and includes a flame port 30 leading therefrom and into the interior volume 32 of the case. Notably, the flame port 30 comprises a straight through bore having an inwardly terminal opening whose rim 34 is defined by the junction of the straight wall of the through bore with the inside rearward wall 36 of the case which is oriented normally of the wall of the through bore. By this means, the rim 34 is sharply defined so that a flame generated by the firing of the primer 28 exits the flame port 30 in a substantially collimated flame that projects itself into the interior volume 32 of the case to ignite a powder charge 38 disposed therein.

A projectile 40 is disposed in and closes the leading end 18 of the case. A charge of gunpowder 38 is disposed within the case interior 32 and occupies at least a portion of the case interior 32 between a trailing end 42 of the projectile 40 and the flame port 30 of the case. When the gunpowder 38 is exposed to burning gas generated by the firing of the primer 28 at the trailing end 16 of the case, the gunpowder 38 is ignited and burns, resulting in a buildup of gas pressure within the case 14 sufficient to propel the projectile 40 from the leading end 18 of the case 14, along the barrel of the firearm, and outwardly therefrom, thereby firing the projectile 40 from the firearm. In several embodiments, the combustion of the gunpowder 38, and the corresponding buildup of gas pressure within the case 14 and barrel of the firearm, is further sufficient to operate one or more gas-operated features of the firearm, such as for example a gas-operated bolt, slide, or other such mechanism of the firearm.

While in the illustrated embodiment the above-discussed propellant employed in the cartridge 12 is a measure of gunpowder 38, it will be recognized that other substances may be used to accomplish the propellant without departing from the spirit and scope of the present general inventive concept. To this end, as used herein, the terms "gunpowder," "powder charge," and the like will be understood to encompass various types of granular and/or fluid materials suitable for use as a propellant in an ammunition cartridge. For example, it will be recognized that, in certain embodiments, smokeless gunpowder, black powder, flash powder, or other similar substances may be used as propellant in the cartridge 12 as described herein without departing from the spirit and scope of the present general inventive concept.

The specific quantity and/or volume of gunpowder 38 within the case 14 is sufficient such that, upon ignition and combustion of the gunpowder 38, sufficient gas pressure is developed within the case 14 to propel the projectile 40 at a desired velocity, while simultaneously generating and sustaining any minimum gas pressure necessary within the firearm in order to operate the various mechanical components of the firearm. To this end, it will be recognized that the exact quantity and/or volume of gunpowder 38 contained within the case 14 may vary depending upon several factors, including, but not limited to, the given characteristics of the particular gunpowder employed (i.e., its burn rate, etc.), the given characteristics of the particular projectile 40 to be fired (i.e., caliber, mass, shape, dimensions, etc.), the dimensional characteristics of the case 14, the characteristics of the firearm from which the ammunition is to be fired, and the specific needs and/or desires of the user for the specific round of ammunition. In several embodiments, the charge of gunpowder 38 occupies materially less than all of the interior volume 32 of the case 14, and in some embodiments less than 50% of the total volume of the interior 32 of the case 14.

As noted, the present general inventive concept may, in several embodiments, address the problem of maintaining at least a significant portion of the gunpowder 38 in a relatively stable position within the case, while limiting, and in some embodiments minimizing, the development of void spaces not occupied by the volume of gunpowder 38 between the flame port 30 and the rear surface 42 of the projectile 40, thereby ensuring a more consistent ignition of the gunpowder within the case throughout a range of orientations of the round of ammunition. To this end, in the illustrated embodiment, an insert 44 is provided within the case interior 32 to reduce the overall effective volume of case interior 32 which may be occupied by the gunpowder 38 and to maintain at least a portion of the powder charge 38 in a location between the flame port 30 and the projectile 40, accessible by the jet of burning gas projected through the flame port 30 from the primer 28. In the embodiment of FIG. 1, the insert 44 is generally tubular in shape, having an outer circumferential surface which substantially matches the internal surface of the trailing tubular portion 22 of the case. In the illustrated embodiment, the insert 44 extends between the interior of the trailing end 16 of the casing and the trailing end of the leading tubular portion 24 of the case. Thus, a leading end 60 of the insert 44 defines a tapered shape substantially conforming to the interior surface of the tapered portion 48 of the case 14 between the trailing tubular portion 22 and the leading tubular portion 18. In this embodiment, the tapered portion 48 of the case 14 serves to secure the insert 44 generally within the case interior 32 along the length of the trailing tubular portion 22. In certain embodiments, the outer surface of the insert 44 may further be frictionally engaged or otherwise secured to the interior surface of the trailing tubular portion 22. However, it will be recognized that such additional engagement is not necessary in order to accomplish the present invention.

In various embodiments, the insert 44 defines an open-ended central cavity 50 extending generally along a central coaxis 56 of the insert 44 and the case 14. In the illustrated embodiment, the central cavity 50 comprises a through bore having a relatively wide, cylindrical trailing portion 52 which opens axially to a trailing end 54 of the insert 44 adjacent the flame port 30 of the case 14. The trailing portion 52 of the central cavity 50 transitions to a cylindrical leading portion 58 having a diameter narrower than that of the trailing portion 52. In several embodiments, the powder charge 38 is confined entirely within the central cavity 50 between the flame port 30 and the trailing end 42 of the projectile 40. For example, in the illustrated embodiment, the diameter of the leading portion 58 of the central cavity 50 substantially matches the outer diameter of the trailing end 42 of the projectile 40, and the trailing end 42 of the projectile 40 extends into the leading portion 58 of the central cavity 50, thereby closing the leading end 60 of the insert 44 and containing the powder charge 38 within the central cavity 50. In another embodiment, the diameter of the leading portion 58 of the central cavity 50 is less than the outer diameter of the trailing end 42 of the projectile 40, and the trailing end 42 of the projectile 40 abuts the leading end 60 of the insert 44 adjacent the leading portion 58 of the central cavity 50, thereby closing the leading end 60 of the insert 44. In various other embodiments, gunpowder 38 may flow from the central cavity 50 into the region of the case interior 32 surrounding the trailing end 42 of the projectile 40. For example, in certain embodiments, the diameter of the leading portion 58 of the central cavity 50 is greater than the outer diameter of the trailing end 42 of the projectile 40. In other embodiments, the trailing end 42 of the projectile 40 terminates forward of the leading end 60 of the insert 44. However, in various embodiments, including embodiments in which the gunpowder 38 is maintained entirely within the central cavity 50 and embodiments in which a portion of the gunpowder 38 may flow from the central cavity 50 into the region of the case interior 32 surrounding the trailing end 42 of the projectile 40, the size of the central cavity 50 in relation to the remainder of the case interior 32 is such that at least a portion of the gunpowder forming the powder charge 38 is maintained within the central cavity 50, such that at least a portion of the gunpowder 38 is accessible by the jet of burning gas projected through the flame port 30 from the primer 28.

In several embodiments, the volume of the central cavity 50 between the flame port 30 and the trailing end 42 of the projectile 40 is only slightly greater than the volume of the powder charge 38 received therein. Thus, the gunpowder forming the powder charge 38 is maintained in a relatively stable location between the flame port 30 and the trailing end 42 of the projectile 40 throughout various changes in orientation of the cartridge 12. For example, as shown in FIG. 1, orientation of the cartridge 12 in an upward direction, that is, with the leading end 18 of the casing 14 above the trailing end 16, allows the gunpowder 38 within the central cavity 50 to fall generally toward the trailing end 16 of the case, thereby allowing easy communication of burning gas from the flame port 30 to the powder charge 38. As shown in FIG. 2, orientation of the cartridge 12 in a downward direction, that is, with the leading end 18 of the casing below the trailing end 16, allows a small portion of gunpowder 38 to move from the trailing portion 52 of the central cavity into the leading portion 58 of the central cavity 50, thereby filling the leading portion 58. However, in this orientation, the majority of the gunpowder forming the powder charge 38 remains within the trailing portion 52, and only a small void is formed between the flame port 30 and the powder charge 38. Thus, in this downward orientation, flame produced by the primer 28 and directed through the flame port 30 may still readily reach and ignite the powder charge 38.

In some embodiments, the volume of the central cavity 50 between the flame port 30 and the trailing end 42 of the projectile 40 is approximately equal to the volume of the powder charge 38 received therein. Thus, minimal movement of the powder charge 38 within the central cavity 50 occurs as the orientation of the cartridge 12 is changed. In other embodiments, the volume of the central cavity 50 between the flame port 30 and the trailing end 42 of the projectile 40 may slightly exceed the volume of the powder charge 38. It will be recognized that, in such embodiments, the additional volume of the central cavity 50 may allow for slight adjustments or variance in the amount of gunpowder provided during manufacture of the cartridge 12 and/or in the depth at which the projectile 40 is seated within the case leading end 18 during manufacture of the cartridge 12.

The insert 44 is preferably fabricated from any of a variety of substantially rigid and relatively strong materials suitable to withstand the buildup of gas pressure within the central cavity 50 due to combustion of the powder charge 38 absent significant deformation or fracturing of the insert 44 such as would likely impede expulsion of the projectile 40 from the leading end 18 of the case 14. For example, in the illustrated embodiment, the insert 44 is fabricated from a substantially rigid and durable polymer material. However, it will be recognized that numerous other suitable materials, including but not limited to metal, wood, ceramic, and the like, may be used for fabrication of the insert 44 without departing from the spirit and scope of the present general inventive concept. Furthermore, it will be recognized that the insert 44 may be fabricated from a number of flexible and/or deformable materials, such as for example polymer foam, rubber, gel, or the like, without departing from the spirit and scope of the present general inventive concept.

Figure 3:
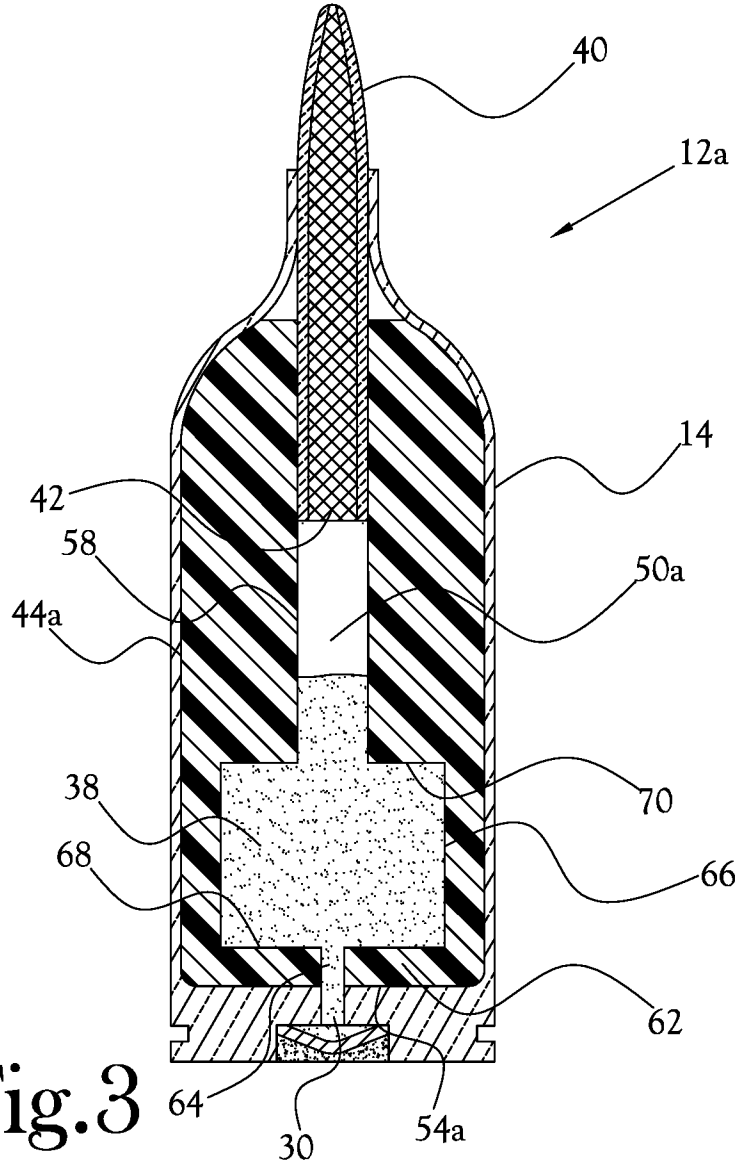
FIG. 3 is a cross-sectional side view of another embodiment of a round of firearm ammunition embodying various features of the present general inventive concept.

FIG. 3 depicts another embodiment of a cartridge **12*a* constructed in accordance with several features of the present general inventive concept. In the embodiment of FIG. 3, the insert 44*a* defines an integrally-formed annular plate portion 62 extending along a trailing end 54*a* thereof. The central cavity 50*a* of the insert 44*a* defines a trailing portion 64 axially aligned with the flame port 30 of the case 14, and having a diameter approximately equal to the diameter of the flame port 30. On a leading side of the plate portion 62 of the insert 44*a*, the trailing portion 64 of the central cavity 50*a* transitions to a central portion 66 having a relatively wide diameter and forming a chamber for containment of the majority of the gunpowder forming the powder charge 38. The central portion 66 of the central cavity 50***a* transitions to a leading portion 58 having a diameter narrower than that of the central portion 66, and in the illustrated embodiment, approximately equal to the outer diameter of the projectile 40.

In the embodiment of FIG. 3, the majority of the powder charge 38 is maintained within the central portion 66 of the central cavity 50*a*, between the plate portion 62 of the insert 44*a* and the leading portion 58 of the central cavity 50*a*. Thus, upon ignition of the powder charge 38, gas pressure buildup within the case 14 results in the application of such pressure against a leading surface 68 of the plate portion 62 of the insert 44*a*, as well as against a leading surface 70 of the central portion 66 of the central cavity 50*a*, between the central and leading portions 66, 58 of the central cavity 50*a*. It will be recognized that these applications of pressure within the central portion 66 of the central cavity 50*a* may act upon the insert 44*a* in opposition to one another, thereby reducing bias of the insert 44*a* in relation to the case 14 during combustion of the powder charge 38. Thus, the plate portion 62 of the insert 44*a*, together with the constriction of the central cavity 50*a* between the central and leading portions 66, 58, may assist in discouraging gas pressure within the insert 44*a* from dislodging or otherwise shifting the insert 44*a* along the length of the case 14 during combustion of the powder charge 38, or from deforming the tapered portion 48 of the case 14 during combustion of the powder charge 38.

Figure 4:
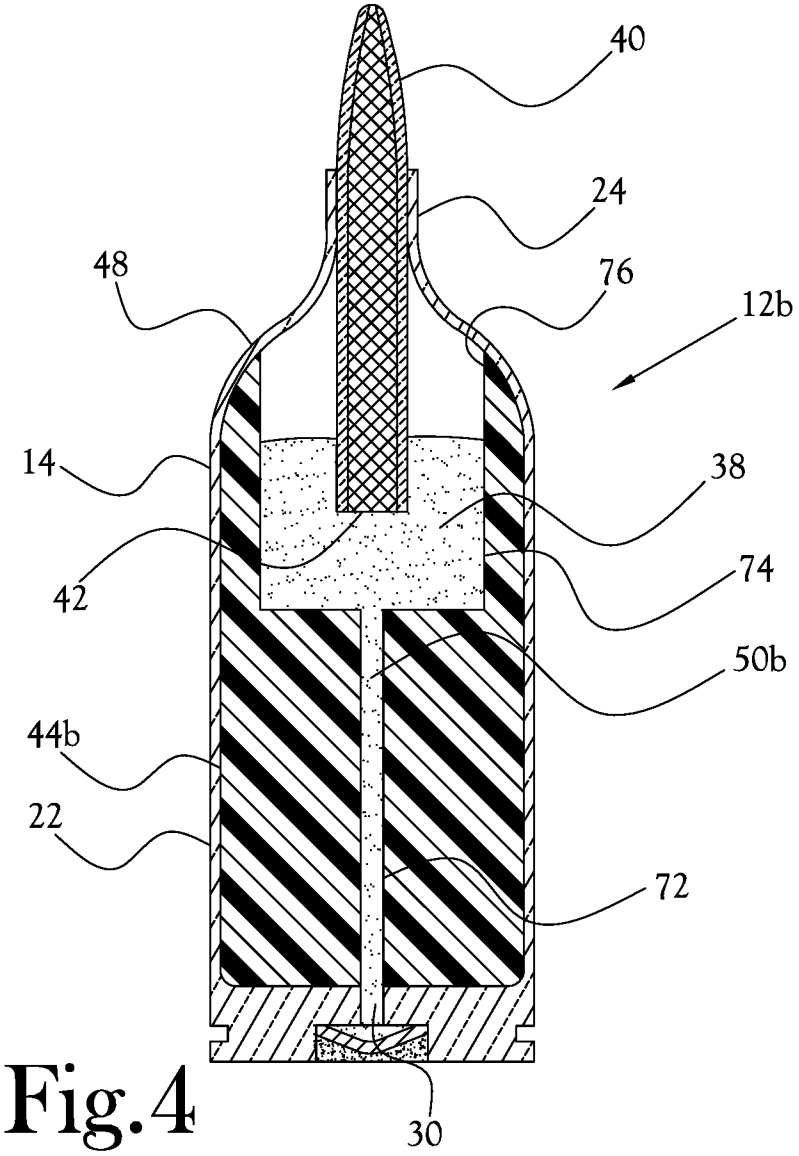
FIG. 4 is a cross-sectional side view of another embodiment of a round of firearm ammunition embodying various features of the present general inventive concept.

FIG. 4 illustrates another embodiment of a cartridge 12*b* constructed in accordance with several features of the present general inventive concept. In the embodiment of FIG. 4, the central cavity 50*b* of the insert 44*b* defines a cylindrical trailing portion 72 which is axially aligned with, and opens to, the flame port 30 of the case 14, and which has a diameter approximately equal to the diameter of the flame port 30. The central cavity 50*b* transitions to a relatively wide, cylindrical leading portion 74 which opens axially to a leading end 76 of the insert 44*b*, proximate the tapered portion 48 of the case 14. In this embodiment, the powder charge 38 is disposed in the space defined by the central cavity 50*b* in combination with the tapered portion 48 of the case 14 between the trailing tubular portion 22 and the leading tubular portion 24. In operation of the embodiment of FIG. 4, upon activation of the primer 28, a flame is emitted through the flame port 30 and is directed along the trailing portion 72 of the insert 44*b* and into the leading portion 74, whereupon the flame may ignite the powder charge 38, thereby causing the round 12*b* to fire.

In the illustrated embodiment, the portion of the exterior surface of the insert 44*b* proximate the leading end 76 defines a slight taper, such that the leading end 76 of the insert 44*b* conforms to a trailing portion of the interior surface of the tapered portion 48 of the case 14. Thus, as in the embodiment of FIGS. 1 and 2 discussed above, the tapered portion 48 of the case 14 serves to secure the insert 44*b* generally within the case interior 32 along the length of the trailing tubular portion 22. In other embodiments, the exterior surface of the insert 44 is cylindrical in shape, and does not include a tapered leading portion. In such embodiments, the insert 44 may terminate at a leading end of the trailing tubular portion 22 of the case 14 and may be sized such that the insert 44 is prevented from sliding axially along the case 14 into the tapered portion 48. Thus, in such embodiments, the tapered portion 48 of the case 14 also serves to secure the insert 44 generally within the case interior 32 along the length of the trailing tubular portion 22.

In a method of manufacture of an ammunition cartridge 12, a case is formed defining a primer port 26 and a flame port 30 as discussed above, and also having a generally tubular, straight side wall with a diameter approximately equal to the diameter of the trailing portion 16 of the case 14. An insert 44 is inserted into an interior of the case, and thereafter, the diameter of a leading end of the case is reduced via axially-inward compression or other means known to one of skill in the art. Thus, the insert 44 is secured within the case 14 via formation of the "necked down" leading tubular portion 24 of the case 14.

In some embodiments, the method of manufacture of the round of ammunition may further comprise fixation of a primer 28 within the primer port 26, placement of a measure of powder 38 at least within the case 14, and preferably within the central cavity 50 of the insert 44 received within the case 14, and placement of a projectile 40 within the leading tubular portion 24 of the case 14. Those of skill in the art will recognize that numerous swaging and other shaping and/or forming operations known in the field of firearm ammunition manufacture, such as for example flaring the leading end of the case 14 prior to insertion of the projectile 40 into the leading tubular portion 24 of the case 14, crimping the leading end of the case 14 following placement of the projectile 40 therein, and/or swaging the length of the case 14 to a specific outer diameter, may be incorporated into the method of manufacture at any of various points throughout the method without departing from the spirit and scope of the present general inventive concept.

From the foregoing description, it will be appreciated that an insert for use in a firearm ammunition cartridge, and a firearm ammunition cartridge employing such an insert, have been provided. The above-described insert significantly increases the reliability of the ammunition cartridge to fire a projectile of the cartridge in a desired manner throughout a broad range of orientations of the cartridge. While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Various example embodiments of the present general inventive concept may also provide a projectile, as well as a firearm ammunition cartridge containing such a projectile, that may itself be formed so as to more efficiently use a reduced amount of gunpowder or other such propellant when compared to a conventional projectile. Such a cartridge may include a projectile that itself houses propellant that ignites to force the projectile out of the cartridge and through the barrel of the firearm. This may be achieved by forming a projectile so as to have a gunpowder chamber, which may be referred to interchangeably herein as a recess, provided in a rearward end of the projectile so that gunpowder may be stored in the chamber. Upon ignition of the gunpowder, or powder charge, located in the gunpowder chamber, gas pressure buildup within the chamber results in the application of high pressure against the surface of the chamber, as well as outward from an open rear end of the projectile, to more efficiently propel the projectile out of the cartridge and through the barrel of the firearm. When combined with an insert such as any of the inserts discussed herein, it will be recognized that these applications of pressure within the insert cavity may act upon the insert in opposition to one another, thereby reducing bias of the insert in relation to the cartridge case during combustion of the powder charge.

Figure 5:
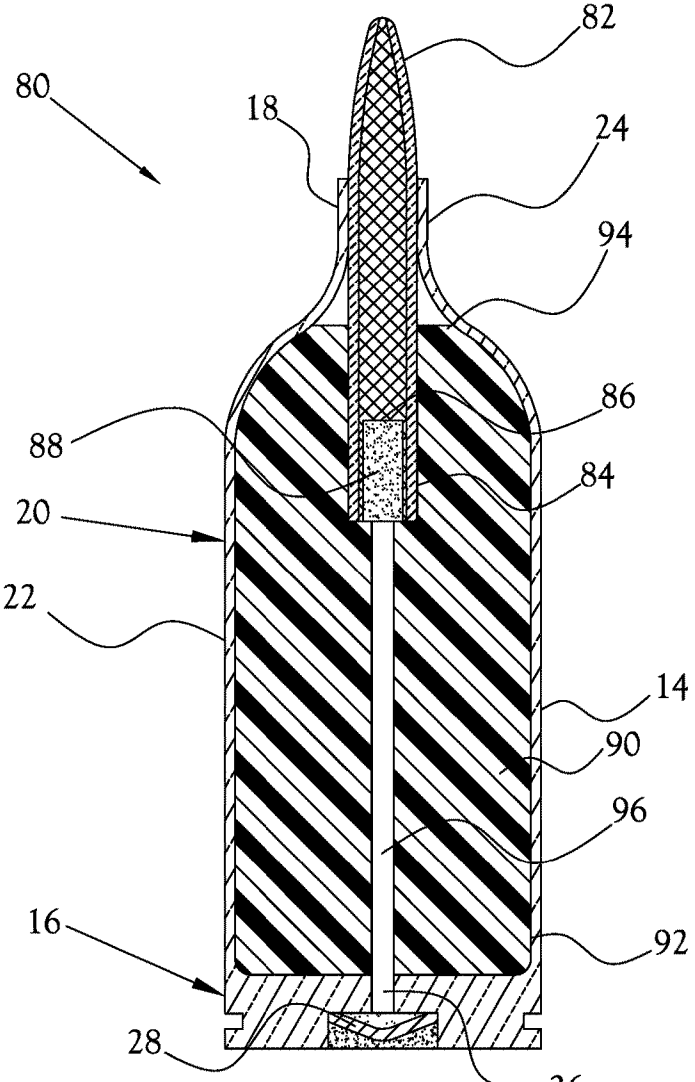
FIG. 5 is a cross-sectional side view of a round of firearm ammunition according to another example embodiment of the present general inventive concept.

FIG. 5 illustrates a cross-sectional side view of a round of firearm ammunition according to another example embodiment of the present general inventive concept. In the example embodiment illustrated in FIG. 5, a firearm ammunition cartridge 80 is similar in many respects to some of the previously described embodiments, but includes a projectile 82 for which a trailing end 84 is formed with a chamber or recess 86 that is configured to hold a compressed gunpowder charge 88. The compressed gunpowder 88 is situated in the recess 86 so as to remain fixed inside the recess 88 until ignited. Therefore, the compressed gunpowder 88 will remain situated in the recess 86 regardless of the orientation of the projectile 82, so that the cartridge 80 may be held, stored, moved, etc., in any position without the compressed gunpowder 88 becoming dislodged. In the example embodiment illustrated in FIG. 5, the compressed gunpowder 88 is shown as substantially filling the entirety of the recess 88, but in other various example embodiments the compressed gunpowder may fill less than the entirety of the recess 88, or may extend outward of the recess 88. Upon ignition, the compressed gunpowder 88 acts upon the walls of the recess 88 of the projectile 82 to propel the projectile out of the case 14 and the barrel of the firearm from which the projectile 82 is being fired. Thus, the compressed gunpowder 88 located in the recess 86 may still be in the recess 86 and producing propelling gasses while the projectile is moving down the barrel of the firearm. In the example embodiment illustrated in FIG. 5, the recess 86 is substantially cylindrical and coaxial with a longitudinal axis of the projectile 82, but in other various example embodiments the recess 86 may be formed in any number of configurations. For example, the recess 86 may be formed in a conical configuration that terminates at a predetermined depth located from a rear surface of the projectile. In other various example embodiments, the recess 86 may be bifurcated or otherwise provided with separate chambers. The recess 86 may be formed during the formation of the projectile 82, or may be excavated from the rear surface of the projectile 82 after the formation of the overall projectile shape. In various example embodiments of the present general inventive concept, the compressed gunpowder 88 may be formed before being inserted into the recess 86, while in other various example embodiments one or more quantities of gunpowder may be compressed inside the recess 86 to form the compressed gunpowder 88.

Figure 6:
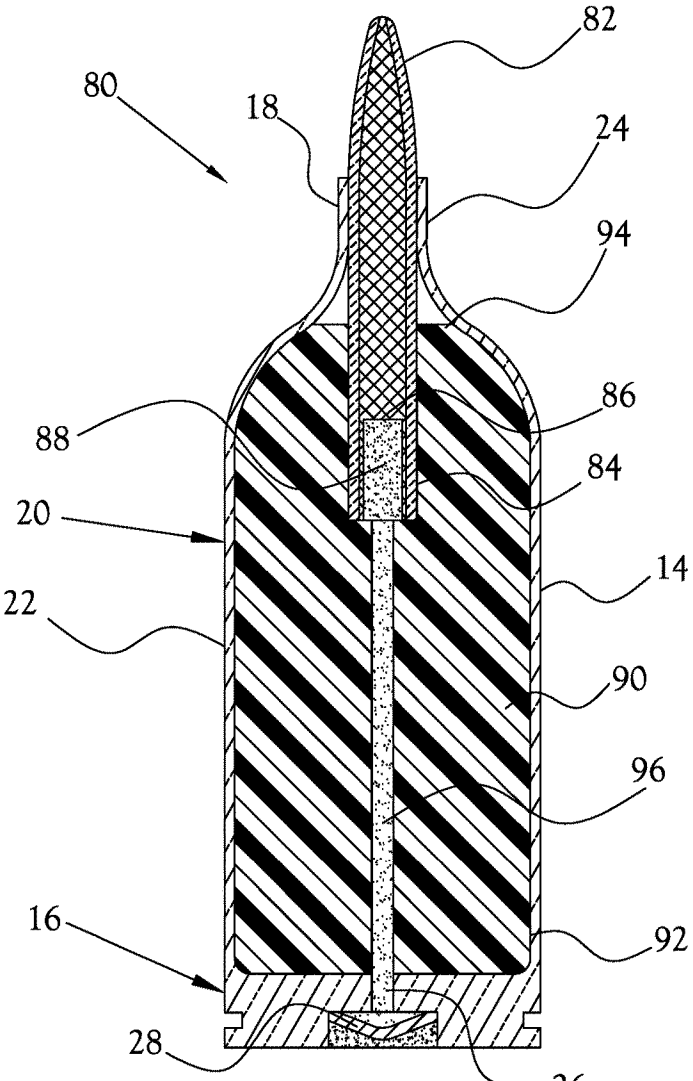
FIG. 6 is a cross-sectional side view of the round of firearm ammunition illustrated in FIG. 5 with additional gunpowder in the flame port.

In the example embodiment illustrated in FIG. 5, an insert 90 is provided inside the case 14 to reduce the interior volume of the case 14 as described in other various example embodiments provided herein. In this example embodiment, a trailing end 92 of the insert 90 abuts a rearmost inner surface of the case 14 interior, and a leading end 94 of the insert 90 abuts an upper inner surface of the case 14 interior such that the trailing end 84 of the projectile 82 is received by the leading end 94 of the insert 90. The insert 90 is formed with a central cavity 96 having a rearmost end that terminates proximate the primer port 26, and a forward end that terminates proximate the rear surface of the trailing end 84 of the projectile 82. Thus, the central cavity 96 effectively forms a flame port between the primer port 26 and the compressed gunpowder 88 located in the recess 86 of the projectile 82, to facilitate the ignition of the compressed gunpowder 88 when the primer 28 is struck by the firing pin of the firearm. In the example embodiment illustrated in FIG. 5, the insert 90 is configured such that the flame port 96 has substantially the same diameter as the primer port 26, but various other example embodiments may provide flame ports with other configurations. For example, the flame port may be configured to have a diameter that is larger or smaller than that of the primer port 26, and/or to have a diameter that is larger, smaller, or substantially the same as the opening of the recess 86 of the projectile 82. When the compressed gunpowder 88 is ignited, the gasses expelled work against the recess 86 walls and the inner surface of the insert 90 to propel the projectile 82 with an efficient use of a much smaller amount of gunpowder than a conventional firearm cartridge. Various example embodiments of the present general inventive concept may be provided with different quantities of gunpowder in the flame port 96 for different desired velocities of the fired projectile 82, and/or to better facilitate the ignition of the compressed gunpowder 86 after the primer 28 is struck. While no additional gunpowder is provided in the example embodiment illustrated in FIG. 5, FIG. 6 illustrates a cross-sectional side view of the round of firearm ammunition illustrated in FIG. 5 with additional gunpowder in the flame port. The example embodiment illustrated in FIG. 6 shows the flame port 96 as being substantially filled with the additional gunpowder, but various other example embodiments may include smaller quantities of additional gunpowder, i.e., additional quantities that do not completely fill the flame port 96. It is noted that various features of the example embodiment illustrated in these drawings, such as, for example, the components of the primer and primer port, may be exaggerated for clarity and ease of understanding.

Figure 7:
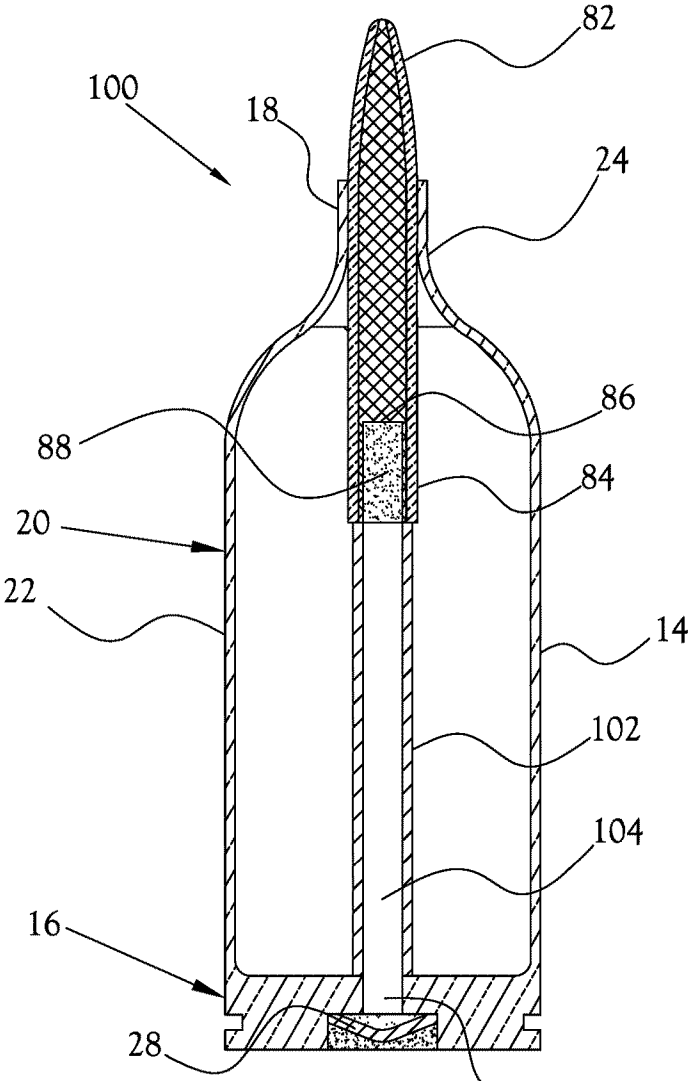
FIG. 7 is a cross-sectional side view of a round of firearm ammunition according to yet another example embodiment of the present general inventive concept.

FIG. 7 illustrates a cross-sectional side view of a round of firearm ammunition according to yet another example embodiment of the present general inventive concept. In this example embodiment, a firearm ammunition cartridge 100 is also provided with the projectile 82 having the recess 86 in which the compressed gunpowder 88 is inserted, but rather than having an insert inside the body of the cartridge 100 to reduce the open volume inside the case 14, a stand tube 102 is provided inside the cartridge 100 to form a flame port 104 between the primer port 26 and the trailing end 84 of the projectile 82 in order to carry the ignition flash from the primer port 26 to the projectile 82. The stand tube 102 may be formed using a variety of materials, and in various example embodiments be formed to withstand the ignition of the compressed gunpowder 88 and the force of the gasses produced by the ignition. Similar to the example embodiments illustrated in FIGS. 5 and 6, the stand tube 102 may be configured to form a flame port 104 to have any desired diameter, such as substantially matching the diameter of the primer port 26, the trailing end 84 of the projectile 82, the recess 86 formed in the trailing end 84 of the projectile 82, and so on. Additionally, in various example embodiments of the present general inventive concept additional quantities of gunpowder may be deposited in the flame port 104 to facilitate the firing of the projectile 82.

Figure 8:
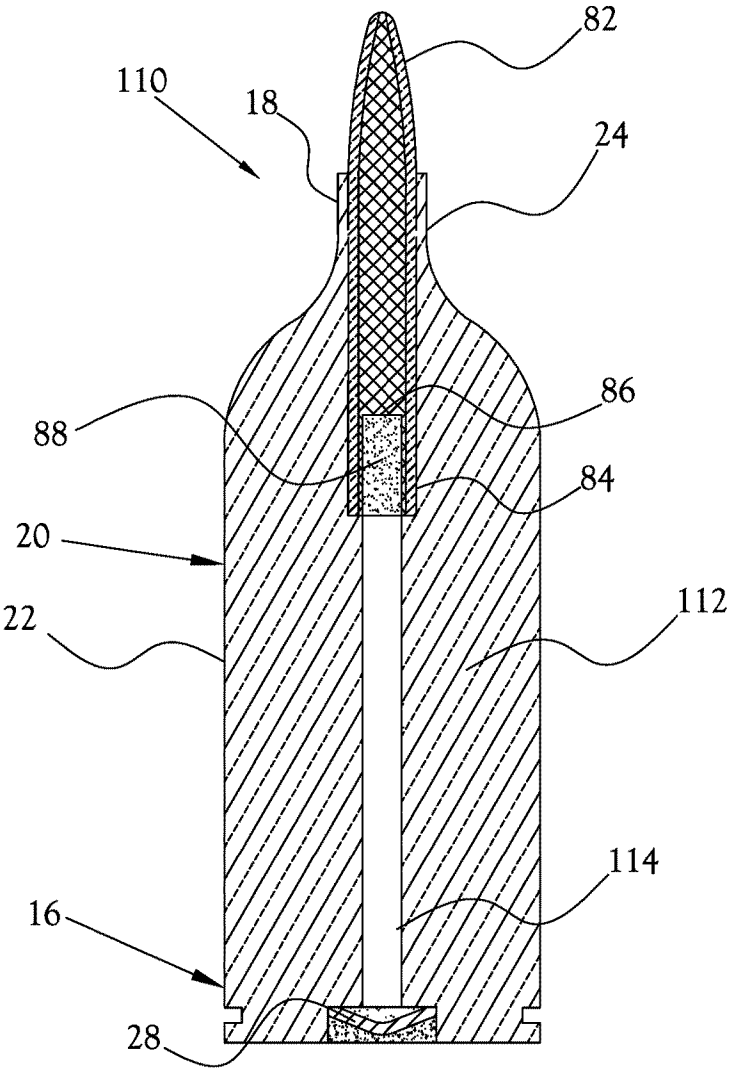
FIG. 8 is a cross-sectional side view of a round of firearm ammunition according to still another example embodiment of the present general inventive concept.

FIG. 8 is a cross-sectional side view of a round of firearm ammunition according to still another example embodiment of the present general inventive concept. In this example embodiment, a firearm ammunition cartridge 110 is formed with a case wall 112 having a thickness sufficient to define a flame port 114 without any additional insert or stand tube.

Thus, the brass or other material used to form the case of the cartridge 110 has a thickness that results in a small substantially cylindrical column between the primer and the projectile 82, effectively forming an extended primer port all the way to the projectile 82. Similar to many of the previously described example embodiments, the flame port 114 may be configured to have any desired diameter, such as substantially matching the diameter of the trailing end 84 of the projectile 82, the recess 86 formed in the trailing end 84 of the projectile 82, and so on. Additionally, in various example embodiments of the present general inventive concept additional quantities of gunpowder may be deposited in the flame port 114 to facilitate the firing of the projectile 82.

Various example embodiments of the present general inventive concept may provide a firearm ammunition cartridge including a case having a substantially tubular body portion, an open leading end, and a trailing end defining a primer port, the primer port opening to an interior of the case, a projectile received and retained within the leading end of the case, and configured with a recess extending inwardly from a trailing end of the projectile to receive a quantity of gunpowder, and a quantity of compressed gunpowder provided in the recess of the projectile such that the compressed gunpowder remains in the recess at any orientation of the projectile. The recess of the projectile may be cylindrical, and may share a longitudinal axis with the projectile. The compressed gunpowder may substantially fill the recess of the projectile. The recess of the projectile may have substantially the same diameter as that of the primer port. The firearm ammunition cartridge may further include an insert received within the case and extending along the body portion, the insert having a central cavity extending along a longitudinal axis of the insert and the projectile, the central cavity opening to the primer port at the trailing end of the case and opening to the recess of the projectile. The firearm ammunition cartridge may further include a quantity of additional gunpowder disposed within the central cavity. The additional gunpowder may define a volume approximately equal to a volume of the central cavity between the trailing end of the projectile and the trailing end of the case. The insert may be configured with an exterior surface conforming to an interior surface of the body portion of the case. The central cavity may be configured with a diameter substantially equal to that of the recess of the projectile. The insert may be configured such that the trailing end of the projectile is received within a leading portion of the insert. The insert may be configured to be fixed within the case. The case may be configured with a tapered portion between the body portion and the leading end, the exterior surface of the insert having a leading portion conforming to an interior surface of the tapered portion of the case, whereby the tapered portion retains the insert within the case between the tapered portion and the trailing end of the case. The firearm ammunition cartridge may further include a stand tube configured to extend from the primer port to the trailing end of the projectile such that the stand tube forms a flame port between the primer port and projectile. An inner diameter of the stand tube may be configured to have substantially the same diameter as the recess of the projectile. The stand tube may share a longitudinal axis with the recess of the projectile. The case may be configured with walls sufficiently thick such that the primer port extends from the trailing end of the case to the trailing end of the projectile. The primer port may have substantially the same diameter as that of the recess of the projectile.

Various example embodiments of the present general inventive concept may provide a projectile to be received and retained within a leading end of a firearm ammunition cartridge case, the projectile including a leading end configured to be exposed outside of the firearm ammunition cartridge case, and a trailing end configured with a recess extending inwardly from the trailing end to receive a quantity of gunpowder. The projectile may further include a quantity of compressed gunpowder provided in the recess such that the compressed gunpowder remains in the recess at any orientation of the projectile. The recess of the projectile may be cylindrical, and may share a longitudinal axis with the projectile.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

Having thus described the aforementioned invention, what is claimed is:

1. A firearm ammunition cartridge comprising:

a case having a substantially tubular body portion, an open leading end, and a trailing end defining a primer port, the primer port opening to an interior of the case;

a projectile received and retained within the leading end of the case, and configured with a recess extending inwardly from a trailing end of the projectile to receive a quantity of gunpowder;

a quantity of compressed gunpowder provided in the recess of the projectile such that the compressed gunpowder remains in the recess at any orientation of the projectile; and an insert received within the case and extending along the body portion, the insert having a central cavity extending along a longitudinal axis of the insert and the projectile, the central cavity opening to the primer port at the trailing end of the case and opening to the recess of the projectile;

wherein the central cavity is configured with a diameter substantially equal to that of the recess of the projectile.

2. The firearm ammunition cartridge of claim 1, wherein the recess of the projectile is cylindrical and shares a longitudinal axis with the projectile.

3. The firearm ammunition cartridge of claim 1, wherein the compressed gunpowder substantially fills the recess of the projectile.

4. The firearm ammunition cartridge of claim 1, wherein the recess of the projectile has a substantially same diameter as that of the primer port.

5. The firearm ammunition cartridge of claim 1, further comprising a quantity of additional gunpowder disposed within the central cavity.

6. The firearm ammunition cartridge of claim 5, wherein the additional gunpowder defines a volume approximately equal to a volume of the central cavity between the trailing end of the projectile and the trailing end of the case.

7. The firearm ammunition cartridge of claim 1, wherein the insert is configured with an exterior surface conforming to an interior surface of the body portion of the case.

8. The firearm ammunition cartridge of claim 7, wherein the case is configured with a tapered portion between the body portion and the leading end, the exterior surface of the insert having a leading portion conforming to an interior surface of the tapered portion of the case, whereby the tapered portion retains the insert within the case between the tapered portion and the trailing end of the case.

9. The firearm ammunition cartridge of claim 1, wherein the insert is configured such that the trailing end of the projectile is received within a leading portion of the insert.

10. The firearm ammunition cartridge of claim 1, wherein the insert is configured to be fixed within the case.

11. A firearm ammunition cartridge comprising:

a case having a substantially tubular body portion, an open leading end, and a trailing end defining a primer port, the primer port opening to an interior of the case;

a projectile received and retained within the leading end of the case, and configured with a recess extending inwardly from a trailing end of the projectile to receive a quantity of gunpowder;

a quantity of compressed gunpowder provided in the recess of the projectile such that the compressed gunpowder remains in the recess at any orientation of the projectile; and a stand tube configured to extend from the primer port to the trailing end of the projectile such that the stand tube forms a flame port between the primer port and projectile;

wherein an inner diameter of the stand tube is configured to have a substantially same diameter as the recess of the projectile.

12. The firearm ammunition cartridge of claim 11, wherein the stand tube shares a longitudinal axis with the recess of the projectile.

13. A firearm ammunition cartridge comprising:

a case having a substantially tubular body portion, an open leading end, and a trailing end defining a primer port, the primer port opening to an interior of the case;

a projectile received and retained within the leading end of the case, and configured with a recess extending inwardly from a trailing end of the projectile to receive a quantity of gunpowder; and a quantity of compressed gunpowder provided in the recess of the projectile such that the compressed gunpowder remains in the recess at any orientation of the projectile;

wherein the case is configured with walls sufficiently thick such that the primer port extends from the trailing end of the case to the trailing end of the projectile; and wherein the primer port has a substantially same diameter as that of the recess of the projectile.

* * * * *